United States Patent [19]

Sheraton et al.

[11] 4,183,467

[45] Jan. 15, 1980

[54] FLUID CONTROL VALVES

[75] Inventors: Ronald F. Sheraton, Pinner; Brian W. Tumber, Greenford, both of England

[73] Assignee: Lucas Industries Limited, Birmingham, England

[21] Appl. No.: 825,417

[22] Filed: Aug. 17, 1977

[30] Foreign Application Priority Data

Jun. 22, 1977 [GB] United Kingdom ..... 26010/77

[51] Int. Cl.[2] ..... B05B 12/00

[52] U.S. Cl. ..... 239/73; 137/509; 137/554; 239/533.3; 123/32 H

[58] Field of Search ..... 137/509, 554; 239/73, 239/533.3; 123/32 AE, 33 J, 32 H, 32 SA

[56] References Cited

U.S. PATENT DOCUMENTS

| | | | |
|---|---|---|---|
| 2,434,151 | 1/1948 | Fisk | 123/32 SA |
| 2,960,973 | 11/1960 | Davis | 123/32 AE |
| 3,124,305 | 3/1964 | Evans | 137/509 X |
| 3,890,995 | 6/1975 | Miller | 137/554 |
| 3,993,247 | 11/1976 | Tyler | 239/73 |
| 4,066,059 | 1/1978 | Mayer | 123/32 AE X |

*Primary Examiner*—Harold W. Weakley

[57] ABSTRACT

A fluid control valve, principally for controlling the flow of fuel to a compression ignition engine, comprises a valve body and a valve member slidable within the body, the valve member co-operating with a seating on the valve body to control the flow of fluid through the valve. A spring urges the valve member into engagement with the seating and in use, the pressure of the fluid entering the valve is arranged to act on the valve member in opposition to the spring so as to lift the valve member off the seating. The valve member and the seating are formed from electrically conductive material and are electrically insulated from each other except when the valve member is engaged with the seating. An electrical terminal extends to the exterior of the valve body and enables the electrical resistance between the valve member and the seating to be measured. The measured electrical resistance provides an indication of movement of the valve member towards and away from the seating.

9 Claims, 4 Drawing Figures

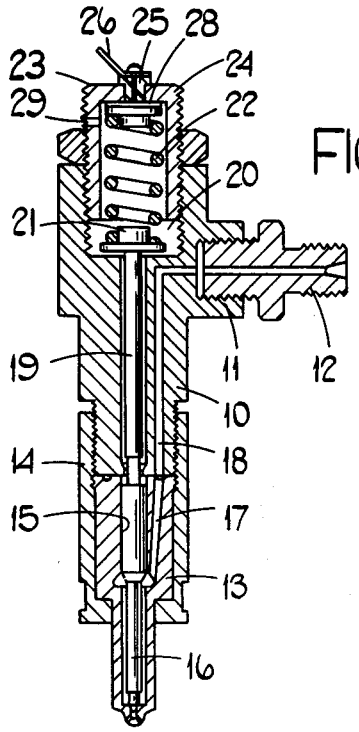
FIG.1.
FIG.2.
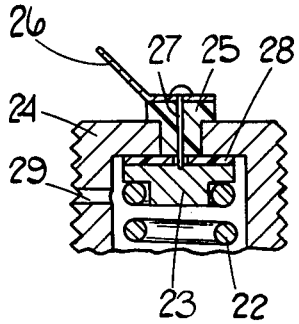
FIG.3.
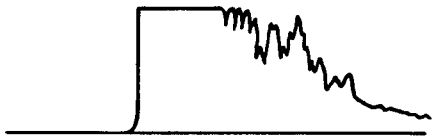
FIG.4.
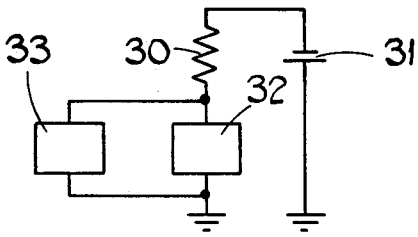

FLUID CONTROL VALVES

This invention relates to fluid control valves of the type comprising a valve body, a fluid pressure actuated valve member slidably supported in the body, a seating defined in the body, said valve member being shaped to co-operate with the seating to prevent flow of fluid through the valve and resilient means acting to urge the valve member into contact with the seating, said valve member in use being urged against the action of the resilient means by fluid under pressure thereby to permit flow of fluid through the valve.

One application for such a valve is to control the flow of fuel to a compression ignition engine and in such an application it is sometimes important to be able to sense the actual instant at which the valve member moves into and out of contact with its seating. This information is useful in order to be able to control the engine performance and also as an aid in diagnosing the condition of the fuel system.

Such valves may also be used as non-return valves to ensure that flow of fluid occurs in one direction only in many types of hydraulic and pneumatic controls. For example, in many forms of hydraulic transmission such valves prevent fluid flow which would cause reverse rotation of, for example, an output member. It is sometimes necessary to be able to detect when the valve operates to prevent the fluid flow. There are of course other examples of application for such valves and the two described arrangements are by way of example only.

There are ways of detecting the movement of the valve member into and out of contact with the seating. In one case there is connected to the valve member or a part movable therewith, an armature which is included in a magnetic circuit also including a sensing coil. A signal is generated in the coil when movement of the armature takes place. The weight of the armature adds to the inertia of the moving parts of the valve so that it adversely influences the opening and closing speeds of the valve member. Whilst it is possible to utilize an existing part of the valve as the armature there are physical constraints of the valve construction which limit the size of the electrical components. It is also known to make use of the variation of capacitance of a capacitor one plate of which is constituted by moving part of the valve. Again the problem is the space within the valve.

The object of the present invention is to provide a fluid valve of the kind specified in a form in which sensing of the movement of the valve member towards and away from the seating when the valve is in use, is facilitated.

According to another aspect of the invention in a valve of the kind specified, the valve member and seating are formed from electrically conductive material, the valve further including electrically insulated terminal means on said body, means within the body connecting said terminal means to the valve member, and further means acting to electrically insulate the valve member from the body except through the seating whereby the electrical resistance between the valve member and the body can be monitored whilst the valve is in use thereby to provide an indication of when the valve member is lifted from or moves into contact with the seating.

One example of a valve in accordance with the invention will now be described with reference to the accompanying drawings as applied to a fuel injector for supplying liquid fuel to an internal combustion engine.

In the drawings:

FIG. 1 is a sectional side elevation of the injector;

FIG. 2 is an enlarged view of a portion of the injector seen in FIG. 1;

FIG. 3 is an oscillogram showing resistance variation; and

FIG. 4 is an electrical circuit diagram.

Referring to FIG. 1 of the drawings, the fuel injector comprises a main body 10 which is of generally cylindrical form and which has a lateral extension 11 having a threaded aperture formed therein which is use, receives a pipe union 12 which constitutes the fuel inlet for the injector.

At one end there is secured to the main body 10, a valve body 13, this being of stepped cylindrical form. The narrower end portion of the valve body projects, in use, through the wall of a combustion space of an engine, and the valve body is retained relative to the main body by a cup-shaped retaining member 14, having an aperture in its base wall through which the narrower portion of the valve body extends.

Formed within the valve body 13 is a bore 15. The bore 15 extends to adjacent the end of the narrower portion of the body and defines a seating for a valve member 16 which is slidable within the bore. The valve member is shaped to co-operate with the seating to prevent flow of fuel through outlet orifices which communicate with the blind end of the bore. The valve member 16 is of stepped form, the narrower portion of the valve member lying generally within the portion of the bore 15 which is formed in the narrower portion of the valve body. There is defined between the valve member and the bore a clearance which is connected by co-operating passages 17, 18 in the valve body and the main body respectively with the aforementioned fuel inlet. As is well known, during manufacture, the valve member and the bore 15 are lapped and a very small clearance exists between the lapped surfaces of the wall of the bore and the valve member, this clearance being occupied by a film of fuel. The valve member is also lapped with the seating but when the valve member is in the closed position metal-to-metal contact is established between the valve member and the valve body through the seating.

Formed in the main body 10 is a further axially extending bore which accommodates a push-rod 19. The push-rod is engaged with an axial projection (not shown) on the valve member 16 and at its other end opens into an enlarged chamber 20. The end of the push rod in the chamber is provided with an abutment 21 for resilient means in the form of a coiled compression spring 22. The other end of the coiled compression spring is engaged about a further abutment 23 which in turn engages a cup-shaped member 24 which is in screw-thread engagement with the wall of the chamber 20. The cup-shaped member 24 is prevented from rotating in the main body by a locknut and an aperture 29 is provided in the member 24 to allow fuel to leak from the chamber 20.

In operation, when fuel under pressure is admitted to the clearance defined between the valve member and the bore 15, the valve member is moved against the action of the coiled compression spring to permit fuel flow through the aforesaid outlets and when the supply of fuel under pressure ceases the valve member is returned into contact with its seating by the action of the coiled compression spring. Any fuel which leaks past the lapped surfaces can flow into the chamber 20 and the fuel accumulating in the chamber 20 can flow through the aperture 29 to a drain.

In order to provide an indication of the movement of the valve member towards and away from the seating, use in made of the variation in the electrical resistance which occurs during such movement, between the valve member 16 and the valve body 13. The valve body is of course electrically connected to the main body 10 and the valve member is connected to terminal means through the push-rod 19, the spring 22 and the abutment 23. The push-rod 19 is spaced from the wall of the bore in which it is mounted as also is the abutment 21 and the spring 22. The abutment 23 as shown in FIG. 2 is insulated from the cup-shaped member 24 by means of an electrically insulating disc 28 so that the only direct electrical connection between the valve member and the valve body occurs when the valve member is in contact with the seating. In this respect it should be noted that the film of fuel within the small clearance between the valve member and the wall of the bore 15 acts to electrically insulate the valve member from the valve body. It will of course be appreciated that the degree of insulation offered by the film of fuel or other fluid depends upon a number of factors, e.g. the conductivity of the fluid, the thickness of the film and the area of the film. The term insulate used herein is therefore in a sense a relative term because when the valve member is out of contact with the seating there will be a resistance value but this will be much higher than when metal contact exists between the valve member and the seating.

The abutment 23 has secured thereto an electrical conductor 27 which passes through an insulating collar 25 located within an aperture in the base wall of the cup-shaped member and is connected to an electrical connector 26.

The electrical resistance offered by the unit is measured between the electrical terminal 26 and the valve body 10 and the oscillogram shown in FIG. 3 represents the variation in resistance which is obtained upon movement of the valve member away from its seating. As will be seen from FIG. 3 there is a substantial variation in the resistance when the valve member is moved by the action of fuel under pressure and this variation occurs very quickly. Whilst the valve member is in the open position the resistance remains substantially constant and is determined by the resistance of the fuel film between the valve member and the wall of the bore 15. As will be seen from FIG. 3 the resistance gradually falls as the valve member moves into contact with the seating as the delivery of fuel from the pump is terminated.

The signal which can be obtained because of its initial short rise time offers a very precise indication of the opening of the valve member. Compared with the electrical circuits which need to be associated with the arrangements described earlier to enable this signal to be obtained, the circuit which is used with the present arrangement is simple in nature. One circuit is seen in FIG. 4 and it will be seen that the electrical circuit of the injector at 32, is connected in series with a resistor 30 and a source of electric supply 31. An indicating instrument for example an oscilloscope 33 is connected in parallel with the injector, the resistor being provided to limit the current flow when the valve member is in the closed position. It will be appreciated that the electrical circuit of the injector is the equivalent of a switch.

We claim:

1. A fuel injector comprising an injector body with a bore defined by a wall of said body, a fluid pressure actuated valve member slidably supported in the bore by said wall, a seating defined in the body, said valve member being shaped to co-operate with the seating to prevent flow of fluid through the injector, the valve member and seating being formed from electrically conductive material, resilient means acting to urge the valve member into contact with the seating, said valve member in use, being lifted from said seating against the action of the resilient means by fluid under pressure to permit flow of fluid through the injector, electrically insulated terminal means on said body, means within the body connecting said terminal means to the valve member, and a film of the fluid in the injector being the sole means for electrically insulating the valve member from the wall of the bore and from the body when said valve member is lifted from the seating, whereby the electrical resistance between the valve member and the body can be monitored whilst the injector is in use thereby to provide an indication of when the valve member is lifted from or moved into contact with the seating.

2. A fuel injection nozzle according to claim 1 in which the means within the body connecting the terminal means to the valve member includes a coiled spring which forms said resilient means.

3. A fuel injection nozzle according to claim 2, including an abutment engaging one end of said spring, and an electrically insulating washer, disposed between said abutment and a body part, said abutment being electrically connected to said terminal means.

4. A fuel injection nozzle according to claim 3, including a further spring abutment engaging the other end of said spring and a rod mechanically and electrically coupling said further abutment to the valve member.

5. A fuel injection nozzle according to claim 1, said nozzle body including a main body, and a valve body retained relative to the main body, a bore in said main body opening into a chamber which accommodates a coiled spring forming said resilient means, a rod connecting said spring to the valve member, said rod being insulated from the main body, an end closure for the chamber, said end closure mounting said terminal means, a spring abutment interposed between the spring and said end closure, a washer acting to insulate said abutment from the end closure, and connecting means connecting said abutment with said terminal means, said rod, spring, abutment and connecting means acting as the means for connecting the valve member to the terminal means.

6. A fuel injector according to claim 5, including passage means in said valve body and main body through which fluid under pressure can flow to act on the valve member to lift the valve member from the seating.

7. A fuel injector according to claim 6, including an outlet for fluid, said outlet being brought into communication with said passage means when the valve member is moved away from the seating.

8. A fuel injector according to claim 7 in which said passage means communicates with a liquid fuel inlet in the main body, said liquid fuel forming a film between the valve member and the wall of a bore in which the valve member is mounted to insulate the valve member from the wall of the bore.

9. A fuel injector according to claim 8 including an aperture opening into said chamber to allow liquid fuel to escape therefrom.

* * * * *